US012371074B2

(12) United States Patent
Li et al.

(10) Patent No.: US 12,371,074 B2
(45) Date of Patent: Jul. 29, 2025

(54) VEHICLE INSTRUMENT DESK DEVICE AND VEHICLE

(71) Applicant: BYD COMPANY LIMITED, Shenzhen (CN)

(72) Inventors: Lujun Li, Shenzhen (CN); Yubin Wang, Shenzhen (CN); Kunzhou Li, Shenzhen (CN); Shihua Li, Shenzhen (CN); Xuebing Ye, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 908 days.

(21) Appl. No.: 17/616,077

(22) PCT Filed: Jun. 24, 2020

(86) PCT No.: PCT/CN2020/098148
§ 371 (c)(1),
(2) Date: Dec. 2, 2021

(87) PCT Pub. No.: WO2020/259596
PCT Pub. Date: Dec. 30, 2020

(65) Prior Publication Data

US 2022/0324491 A1 Oct. 13, 2022

(30) Foreign Application Priority Data

Jun. 28, 2019 (CN) ..... 201910577525.4

(51) Int. Cl.
*B61C 17/04* (2006.01)
*B61C 17/00* (2006.01)
*B61C 17/12* (2006.01)

(52) U.S. Cl.
CPC ..... *B61C 17/04* (2013.01); *B61C 17/00* (2013.01); *B61C 17/12* (2013.01)

(58) Field of Classification Search
CPC ..... B61C 17/04; B61C 17/12; B61C 17/00
USPC ..... 105/456
See application file for complete search history.

(56) References Cited

U.S. PATENT DOCUMENTS 4,184,434 A * 1/1980 Chapin ..... B61C 17/04 105/340

FOREIGN PATENT DOCUMENTS

| | | | | |
|---|---|---|---|---|
| CN | 1681696 A | | 10/2005 | |
| CN | 100374335 C | * | 3/2008 | ..... B61C 17/04 |
| CN | 201036413 Y | | 3/2008 | |
| CN | 205198747 U | | 5/2016 | |
| CN | 106820580 A | | 6/2017 | |
| CN | 206394596 U | | 8/2017 | |

(Continued)

OTHER PUBLICATIONS

The World Intellectual Property Organization (WIPO) International Search Report for PCT/CN2020/098148 Sep. 29, 2020 4 pages (with translation).

*Primary Examiner* — S. Joseph Morano
*Assistant Examiner* — James William Jones
(74) *Attorney, Agent, or Firm* — Wenye Tan

(57) ABSTRACT

A vehicle instrument desk device includes a left instrument desk body and a right instrument desk body. The left instrument desk body and the right instrument desk body are arranged at an interval to form an escape route between the left instrument desk body and the right instrument desk body, and at least one of the left instrument desk body and the right instrument desk body is equipped with a control device.

12 Claims, 7 Drawing Sheets

(56) References Cited

FOREIGN PATENT DOCUMENTS

| | | | | | | |
|---|---|---|---|---|---|---|
| CN | 206475718 | U | | 9/2017 | | |
| CN | 107380178 | A | * | 11/2017 | ..... | B61C 17/04 |
| CN | 107891874 | A | * | 4/2018 | ..... | B61C 17/00 |
| CN | 107933588 | A | * | 4/2018 | ..... | B61C 17/04 |
| CN | 207737284 | U | * | 8/2018 | | |
| CN | 109109875 | A | * | 1/2019 | ..... | B61C 17/04 |
| CN | 208868027 | U | | 5/2019 | | |
| EP | 0167766 | A2 | | 1/1986 | | |
| EP | 2335992 | A1 | * | 6/2011 | ..... | B61C 17/04 |
| JP | 2650167 | B2 | | 9/1997 | | |
| KR | 20100103071 | A | * | 9/2010 | | |
| KR | 101525083 | B1 | * | 6/2015 | | |
| WO | 2014006389 | A1 | | 1/2014 | | |
| WO | WO-2015155287 | A1 | * | 10/2015 | ..... | B61C 17/04 |
| WO | WO-2017021457 | A1 | * | 2/2017 | ..... | B61C 17/04 |
| WO | WO-2019186673 | A1 | * | 10/2019 | ..... | B61C 17/00 |

* cited by examiner

VEHICLE INSTRUMENT DESK DEVICE AND VEHICLE

CROSS-REFERENCE TO RELATED APPLICATIONS

The present disclosure is a national phase entry under 35 U.S.C. $371 of International Application No. PCT/CN2020/098148, filed on Jun. 24, 2020, which claims priority to Chinese Patent Application No. 201910577525.4 filed by the BYD Co., Ltd. on Jun. 28, 2019, and entitled VEHICLE INSTRUMENT DESK DEVICE AND VEHICLE, the entire content of all of which is incorporated herein by reference in its entirety.

FIELD

The present disclosure relates to the field of vehicle instrument desk technologies, and specifically, to a vehicle instrument desk device and a vehicle.

BACKGROUND

An instrument desk is an important component of a rail vehicle such as a metro train, and the instrument desk is integrally arranged in a driving cab substantially in a width direction of the vehicle. Operating devices such as an operating button and a display unit of the vehicle are substantially all disposed on the instrument desk. For example, both a head compartment and a tail compartment of an existing metro train are equipped with an instrument desk. In this way, a driver sits in front of the instrument desk and operates the instrument desk, to control the metro train to run.

In addition, with the development of vehicle technologies, unmanned driving technologies are increasingly mature, and therefore the driver does not need to sit in front of the instrument desk all the time to operate the vehicle at any time. However, in an existing unmanned vehicle, an instrument desk of the vehicle is also integrally arranged in a width direction of the vehicle, that is, the instrument desk substantially occupies an entire width of a driving cab, and an occupies a large space.

SUMMARY

An objective of the present disclosure is to provide a vehicle instrument desk device, and the vehicle instrument desk device may effectively reduce an occupied space and effectively use the occupied space as an escape route, to improve safety performance of a vehicle.

To achieve the above objective, the present disclosure provides a vehicle instrument desk device, including a left instrument desk body and a right instrument desk body, where the left instrument desk body and the right instrument desk body are arranged at an interval to form an escape route between the left instrument desk body and the right instrument desk body, and at least one of the left instrument desk body and the right instrument desk body is equipped with a control device.

According to the above technical solution, since the left instrument desk body and the right instrument desk body are arranged at an interval to form a certain interval space between the left instrument desk body and the right instrument desk body, and the interval space may be used as the escape route, compared with the existing technology in which an instrument desk substantially occupies an entire width of a vehicle, the vehicle instrument desk device of the present disclosure may effectively reduce an occupied space, and use a saved space as the escape route. Therefore, the safety performance of the vehicle is improved, and meanwhile a driver may operate the vehicle through the control device.

In an embodiment, the vehicle instrument desk device includes an isolation door disposed in the escape route, the escape route is opened when the isolation door is opened, and the escape route is closed when the isolation door is closed.

In an embodiment, an end of the isolation door is connected to one of the left instrument desk body and the right instrument desk body through a damping hinge, and another end of the isolation door is releasably connected to the other one of the left instrument desk body and the right instrument desk body through a door absorber unit.

In an embodiment, the left instrument desk body includes an accommodating recess, and the control device is disposed in the accommodating recess; a wall of the accommodating recess is slidingly equipped with a slide cover, the slide cover can slide along a reference straight line to open and cover the accommodating recess, and an extending direction of the reference straight line is consistent with a direction from the left instrument desk body to the right instrument desk body.

In an embodiment, a support pin is formed on one of the slide cover and the right instrument desk body, and a support sleeve is formed on the other one of the slide cover and the right instrument desk body, where when the slide cover opens the accommodating recess, the support pin extends into the support sleeve.

In an embodiment, when the escape route is equipped with the isolation door and the isolation door closes the escape route, the slide cover can be slidably supported on the isolation door.

In an embodiment, the wall of the accommodating recess and the slide cover are matched through a slide rail.

In an embodiment, there are two slide rails, and the two slide rails are respectively arranged in parallel and at an interval on two opposite walls of the accommodating recess.

In an embodiment, a limiting pin is formed on one of the slide cover and the left instrument desk body, a limiting sleeve is formed on the other one of the slide cover and the left instrument desk body, and when the slide cover slides to a covering position, the limiting pin extends into the limiting sleeve.

In an embodiment, the left instrument desk body is equipped with a locking unit, and the slide cover is equipped with an open position locking member and a covering position locking member, where when the slide cover slides to an open position, the open position locking member is locked with the locking unit; and when the slide cover slides to the covering position, the covering position locking member is locked with the locking unit.

In addition, an accommodation space used for accommodating accessories is formed in the right instrument desk body.

In addition, the control device includes a display screen, the display screen is disposed in the accommodating recess and can flip between a closed state and a use state relative to the accommodating recess, and when in the use state, the display screen can extend from the accommodating recess and is to be used by an operator; and when in the closed state, the display screen is accommodatable in the accommodating recess.

In an embodiment, the control device includes a primary control panel and a secondary control panel, where the primary control panel is horizontally disposed in the accommodating recess of the left instrument desk body, the secondary control panel is vertically disposed on a mounting table in the accommodating recess, an end of the display screen is disposed on the mounting table through the damping hinge, and the accommodating recess is equipped with a limiting table, where in the closed state of the display screen, the display screen is located above the primary control panel and keeps an interval away from an operating button on the primary control panel through the limiting table, and the slide cover can slide to cover and open the accommodating recess.

Finally, the present disclosure provides a vehicle, a front end of at least one of a head compartment of the vehicle and a tail compartment of the vehicle is equipped with any one of the foregoing vehicle instrument desk devices.

In this way, as mentioned above, the escape route is added to the vehicle, to significantly improve safety performance of the vehicle.

Other aspects and advantages of the present disclosure will be given in the following description, some of which will become apparent from the following description or may be learned from practices of the present disclosure.

DESCRIPTIONS OF REFERENCE NUMERALS

1—Left instrument desk body, 2—Right instrument desk body, 3—Escape route, 4—Isolation door, 5—Damping hinge, 6—Slide cover, 7—Support pin, 8—Support sleeve, 9—Slide rail, 10—Locking unit, 11—Open position locking member, 12—Covering position locking member, 13—Display screen, 14—Primary control panel, 15—Secondary control panel, 16—Mounting table, 17—Limiting table, 18—Inspection door, 19—Handle, 20—Escape door-emergency unlocking switch, 21—Door absorber, 22—Door absorber adjustment support, 23—Buffer block, 24—USB charging port, 25—Limiting sleeve, 26—Slide cover frame.

DETAILED DESCRIPTION

The following describes embodiments of the present disclosure in detail. Examples of the embodiments are shown in the accompanying drawings, and same or similar reference signs in all the accompanying drawings indicate same or similar components or components having same or similar functions. The embodiments described below with reference to the accompanying drawings are exemplary, and are intended to explain the present disclosure and cannot be construed as a limitation to the present disclosure.

Figure 1:
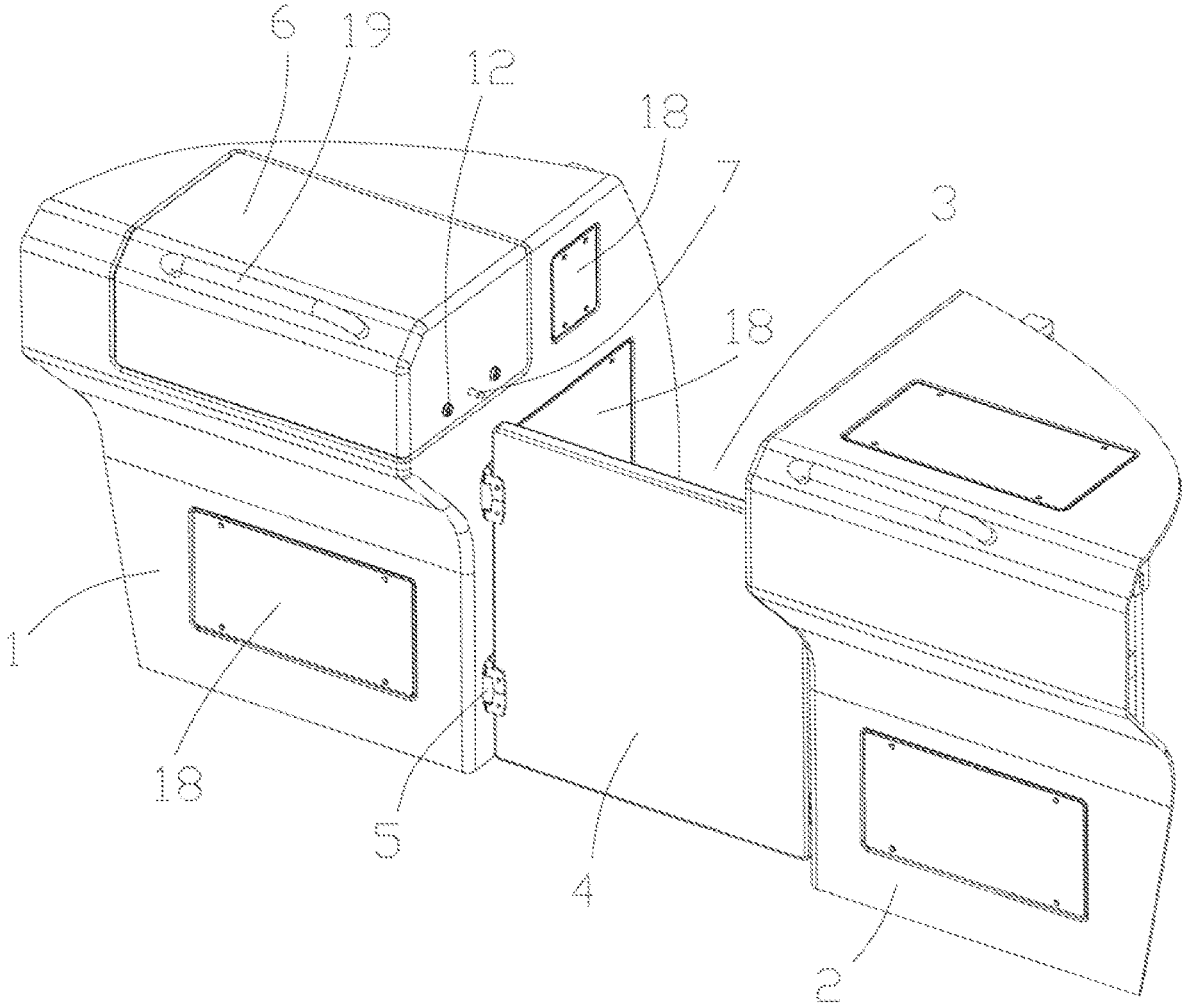
FIG. 1 is a three-dimensional schematic structural diagram of a vehicle instrument desk device according to a specific implementation of the present disclosure, where an isolation door closes an escape route.
Figure 2:
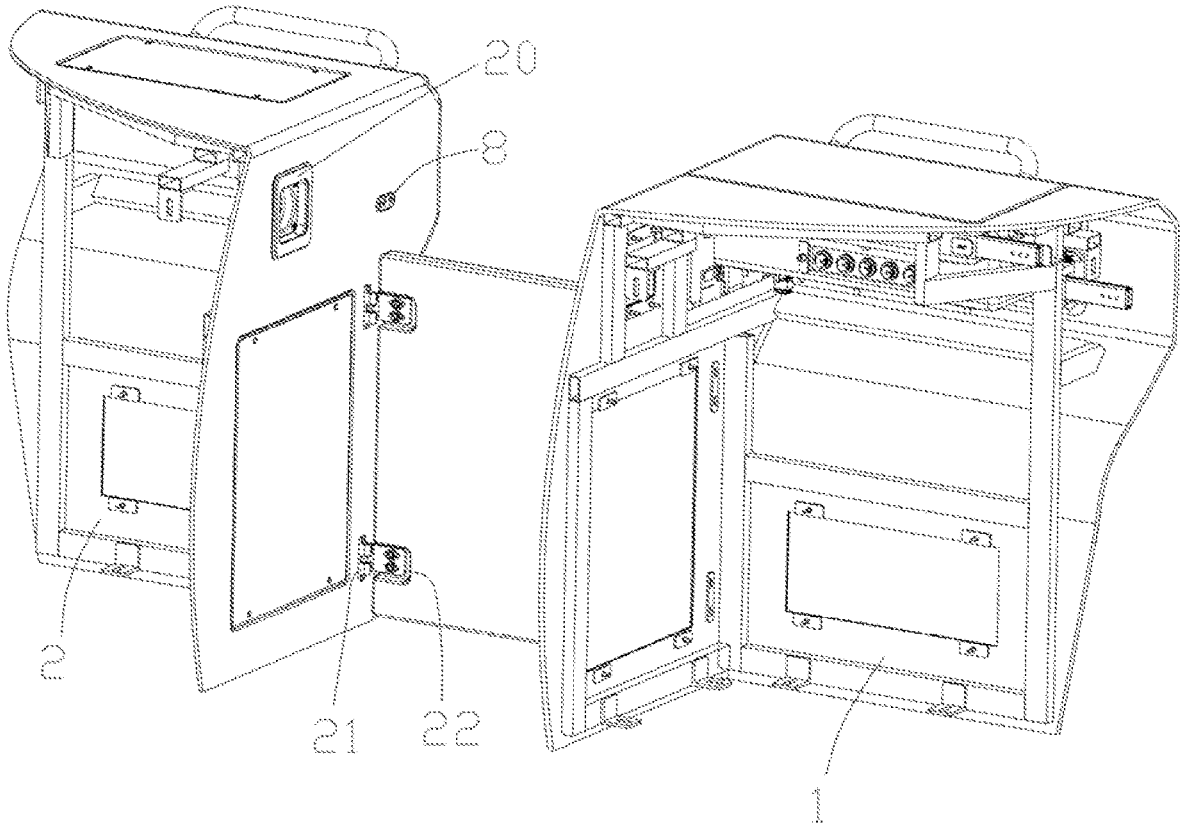
FIG. 2 is a three-dimensional schematic structural diagram of a vehicle instrument desk device in FIG. 1 from another viewing angle.
Figure 3:
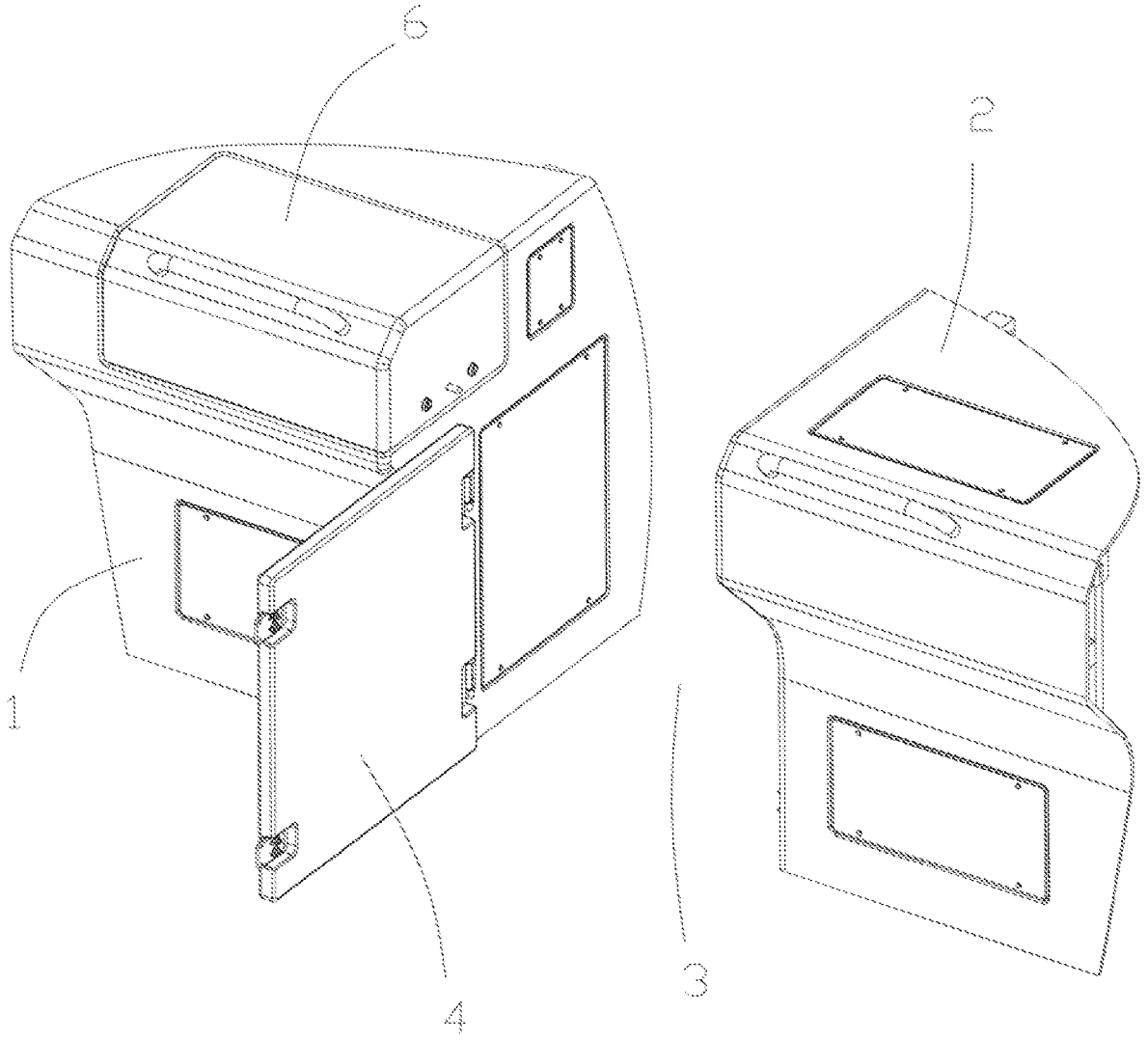
FIG. 3 is a three-dimensional schematic structural diagram of a vehicle instrument desk device in FIG. 1, where an isolation door opens an escape route.

Referring to FIG. 1, FIG. 2 and FIG. 3, a vehicle instrument desk device provided by the present disclosure includes a left instrument desk body 1 and a right instrument desk body 2 that are arranged in a width direction of a vehicle, where the left instrument desk body 1 and the right instrument desk body 2 are arranged at an interval to form an escape route 3 between the left instrument desk body and the right instrument desk body, and at least one of the left instrument desk body 1 and the right instrument desk body 2 is equipped with a control device.

Since the left instrument desk body 1 and the right instrument desk body 2 are arranged at an interval to form a certain interval space between the left instrument desk body and the right instrument desk body, and the interval space may be used as the escape route 3, compared with the existing technology in which an instrument desk integrally extends in a width direction of a vehicle to substantially occupy an entire width of the vehicle, the vehicle instrument desk device of the present disclosure can effectively reduce an occupied space, and use a saved space as the escape route 3. Due to the addition of an escape route 3, a person may leave the vehicle through the escape route 3 if needed, to improve the safety performance of the vehicle, and meanwhile a driver may operate the vehicle through the control device.

Certainly, in the vehicle instrument desk device of the present disclosure, the escape route 3 may be kept in a normally open state, or, as shown in FIG. 1, FIG. 2 and FIG. 3, the vehicle instrument desk device includes an isolation door 4 disposed in the escape route 3; and if needed, a person can manually open the isolation door 4, or the isolation door 4 can be opened automatically. In this way, when the isolation door 4 is opened, the escape route 3 is opened, the person can withdraws from the escape route 3, and when the isolation door 4 is closed, the escape route 3 is closed, to avoid a case that the person passes the escape route 3 because of an accident or negligence, as well as to avoid a case that sundries are piled up in the escape route 3 to affect use of the escape route.

Certainly, the isolation door 4 may be of a plurality of disposing manners. For example, in a disposing manner, the isolation door is retractably disposed on at least one of the left instrument desk body 1 and the right instrument desk body 2. In this way, when the isolation door is retractably disposed in the left instrument desk body 1 and the isolation door extends from the left instrument desk body 1 into the escape route 3, the escape route 3 is closed, and when the isolation door retracts into the left instrument desk body 1, the escape route 3 is opened; when the isolation door is retractably disposed in the right instrument desk body 2 and the isolation door extends from the right instrument desk body 2 into the escape route 3, the escape route 3 is closed, and when isolation door retracts into the right instrument desk body 2, the escape route 3 is opened; and when the isolation door is retractably disposed in the left instrument desk body 1 and the right instrument desk body 2 and the isolation door extends from the left instrument desk body 1 and the right instrument desk body 2 into the escape route 3, the escape route 3 is closed, and when the isolation door retracts into the left instrument desk body 1 and the right instrument desk body 2, the escape route 3 is opened.

Alternatively, in another disposing manner, as shown in FIG. 1, FIG. 2 and FIG. 3, an end of the isolation door 4 is connected to one of the left instrument desk body 1 and the right instrument desk body 2 through a damping hinge 5, another end of the isolation door 4 is releasably connected to the other one of the left instrument desk body 1 and the right instrument desk body 2 through a door absorber unit such as a door absorber 21 and a door absorber adjustment support 22. In this way, when an emergency failure occurs in the vehicle and an emergency escape is needed, the isolation door may be pulled to release the door absorber unit, for example, to separate the door absorber 21 from the door absorber adjustment support 22, then the isolation door is flipped backward by 90°, and after the isolation door is opened by 90°, the isolation door 4 stops at a position of 90° because of a damping effect of the damping hinge 5 itself, to avoid a case that the isolation door 4 automatically returns to affect the escape. Then, an escape door-emergency unlocking switch 20 on the left instrument desk body 1 or the right instrument desk body 2 may be opened, and the emergency escape may be made from a front end or a rear end of the vehicle such as a train after an escape door of the vehicle automatically pops up.

Figure 4:
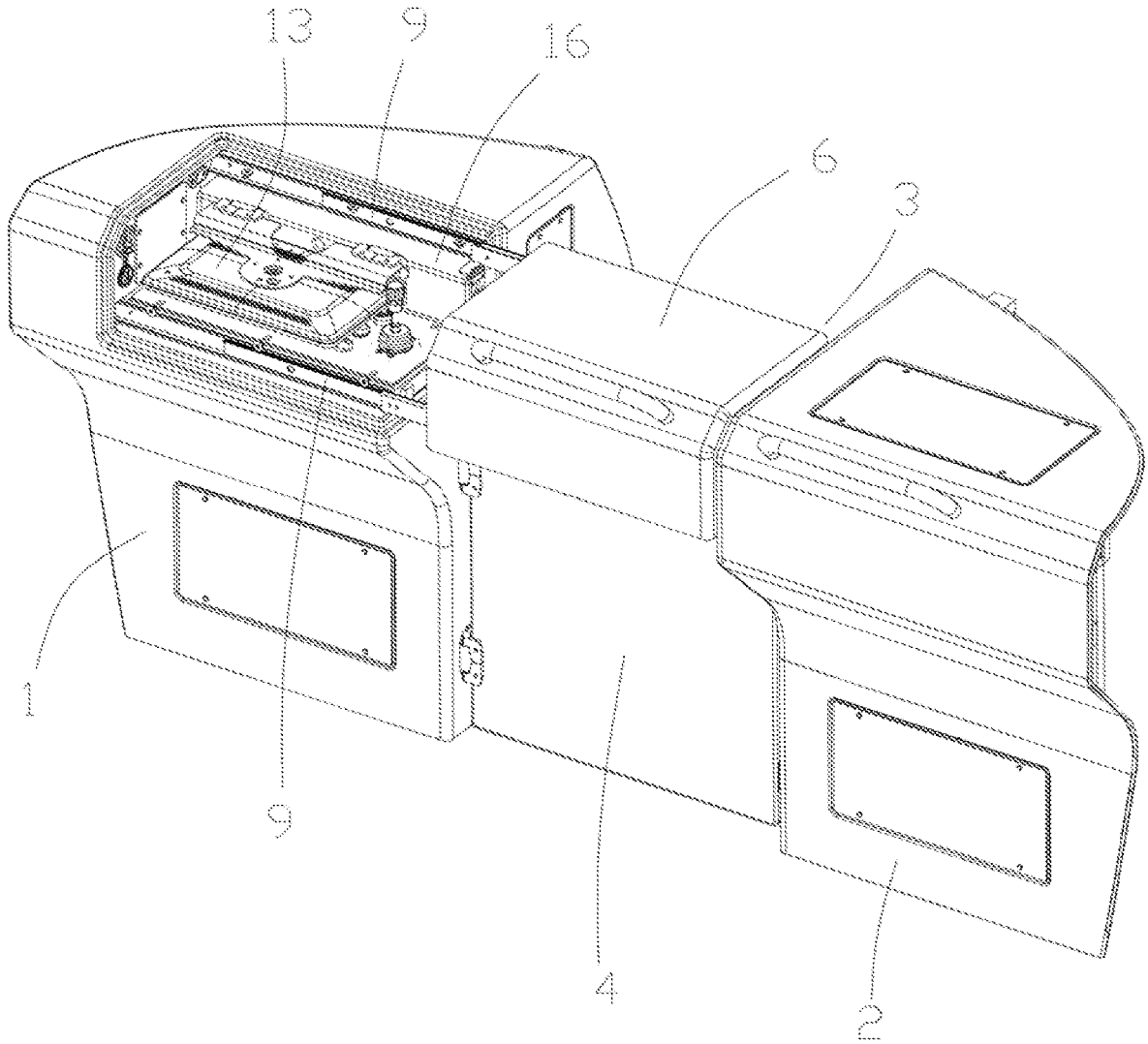
FIG. 4 is a schematic structural diagram of a vehicle instrument desk device in FIG. 1, where a slide cover opens an accommodating recess.
Figure 5:
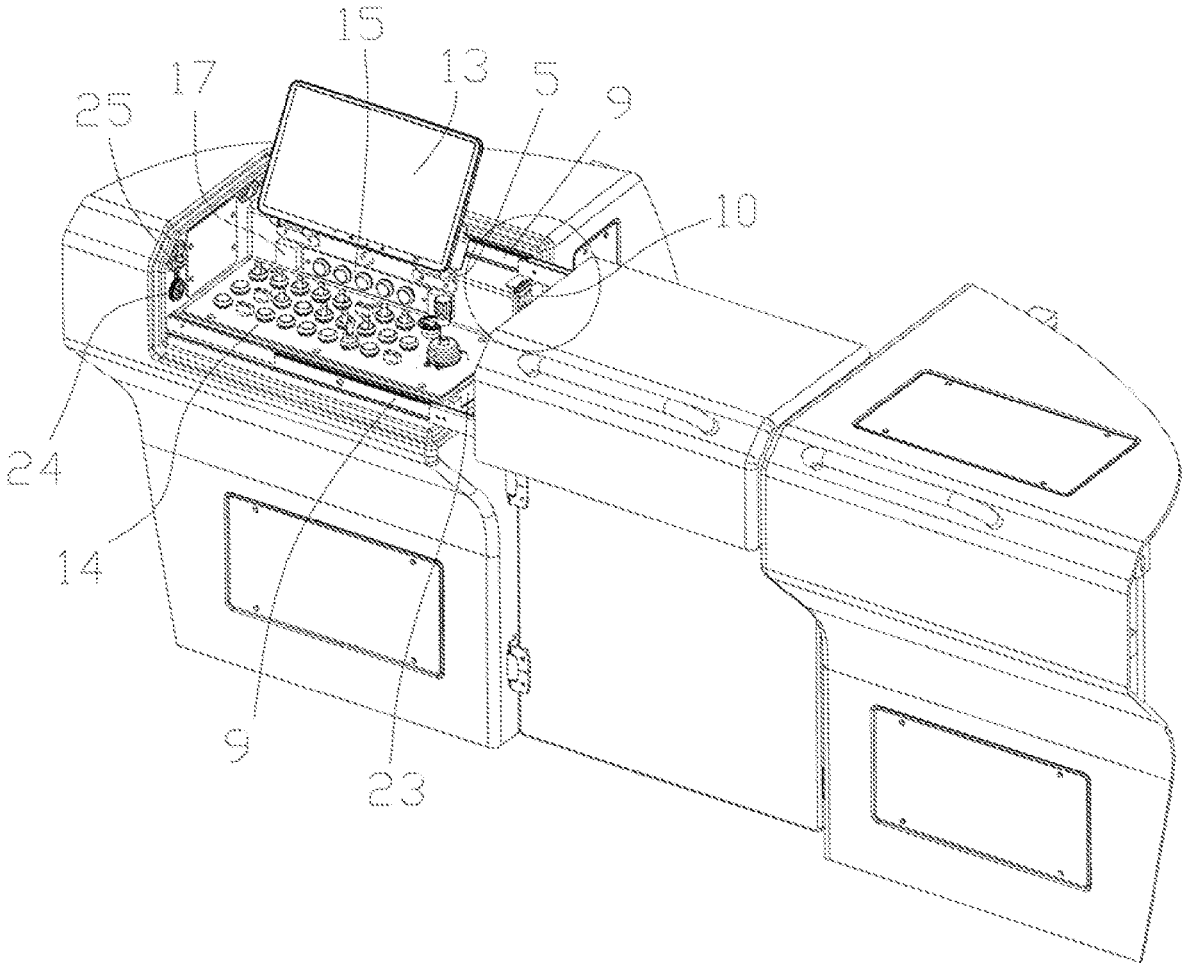
FIG. 5 is a schematic structural diagram of a vehicle instrument desk device in FIG. 4, where a display screen is flipped and opened.

In addition, as shown in FIG. 1, FIG. 4 and FIG. 5, the control device is disposed in the left instrument desk body 1, the left instrument desk body 1 includes an accommodating recess, and the control device is disposed in the accommodating recess; a wall of the accommodating recess is slidingly equipped with a slide cover 6, the slide cover 6 is slidable along a reference straight line to open and cover the accommodating recess, and an extending direction of the reference straight line is consistent with a direction from the left instrument desk body to the right instrument desk body. For example, the slide cover 6 can slide in a direction toward the right instrument desk body 2 to open the accommodating recess, and the slide cover 6 further can slid in a direction away from the right instrument desk body 2 to cover the accommodating recess. In this way, the slide cover 6 may cover the control device in the accommodating recess, so that during an unmanned driving of the vehicle, the control device may be prevented from being exposed outside the left instrument desk body 1, thereby protecting the control device, and a person that is not a staff member may be prevented from inadvertently touching the control device, thereby improving safety performance.

Certainly, when the slide cover 6 is in a state of covering the accommodating recess, an outer surface of the slide cover 6 and another outer surface of the left instrument desk body 1 are in a flush transition, to improve aesthetics of the left instrument desk body 1. In this way, when a vehicle such as a train is in an unmanned driving mode, the slide cover 6 of the left instrument desk body 1 is closed and the isolation door may also be closed, as shown in FIG. 1. In this state, the left instrument desk body 1 functions as a sight-seeing area, and has an instrument desk surface that may be provided for a small piece of luggage to place, and a handle 19 on the left instrument desk body 1 may be provided for a passenger in a front seat or a standing passenger to lean. In addition, the handle 19 may further facilitate application of an external force to slide the slide cover 6.

In addition, the slide cover 6 may smoothly slide in a plurality of disposing manners, for example, smoothly slide through a slide rail, or smoothly slide through a traction rod that is disposed on the slide cover 6 and that matches a guiding channel on the wall of the accommodating recess. In a manner, the wall of the accommodating recess matches the slide cover 6 through the slide rail 9, for example, through limiting fit between the slide rail 9 on the wall of the accommodating recess and a slide block on the slide cover 6, and the slide cover 6 may be caused to smoothly slide.

In an embodiment, there are one or more slide rails 9. As shown in FIG. 4, there are two slide rails 9, and the two slide rails are respectively arranged in parallel and at an interval on two opposite walls of the accommodating recess. In this way, through the plurality of slide rails 9, sliding support may be provided at a plurality of positions of the slide cover 6, to improve slide smoothness of the slide cover 6 and prevent shaking.

Figure 7:
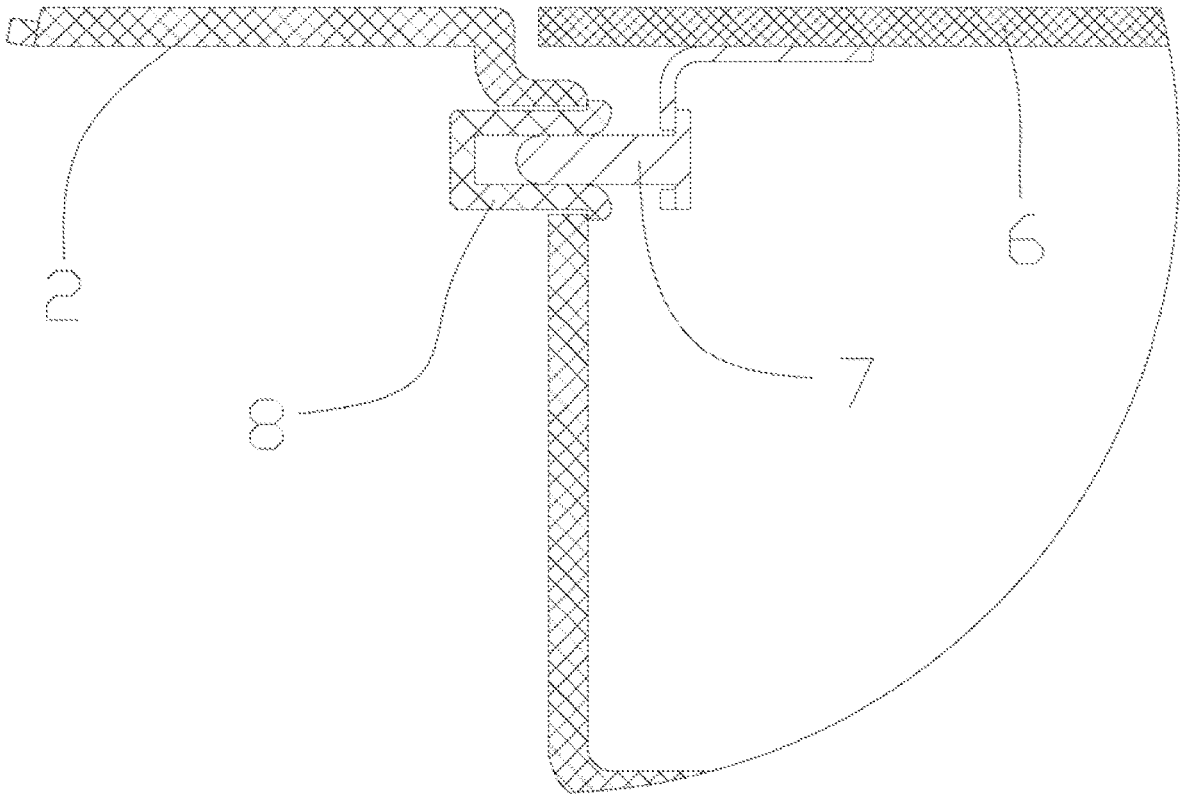
FIG. 7 is a schematic structural diagram, where a support pin matches a support sleeve after a slide cover in FIG. 4 is opened.

In an embodiment, as shown in FIG. 1, FIG. 2 and FIG. 7, a support pin 7 is formed on one of the slide cover 6 and the right instrument desk body 2, and a support sleeve 8 is formed on the other one of the slide cover 6 and the right instrument desk body 2, for example, the support pin 7 is formed on the slide cover 6, and the support sleeve 8 is formed on the right instrument desk body 2, where when the slide cover 6 opens the accommodating recess, the support pin 7 extends into the support sleeve 8. In this way, such matching between the support pin 7 and the support sleeve 8 may strengthen stability of the slide cover in an open state.

In addition, to improve stability and reliability of the slide cover 6 during sliding, the isolation door 4 is disposed in the escape route 3 and when the isolation door 4 closes the escape route 3, the slide cover 6 is slidably supported on the isolation door 4, that is, the slide cover 6 is slidingly supported on the isolation door 4 in this case, for example, an inner surface of the slide cover 6 is slidingly supported on an upper surface of the isolation door 4. In this way, a structure and a position of the isolation door 4 can be fully used to provide sliding support for the slide cover 6.

Figure 6:
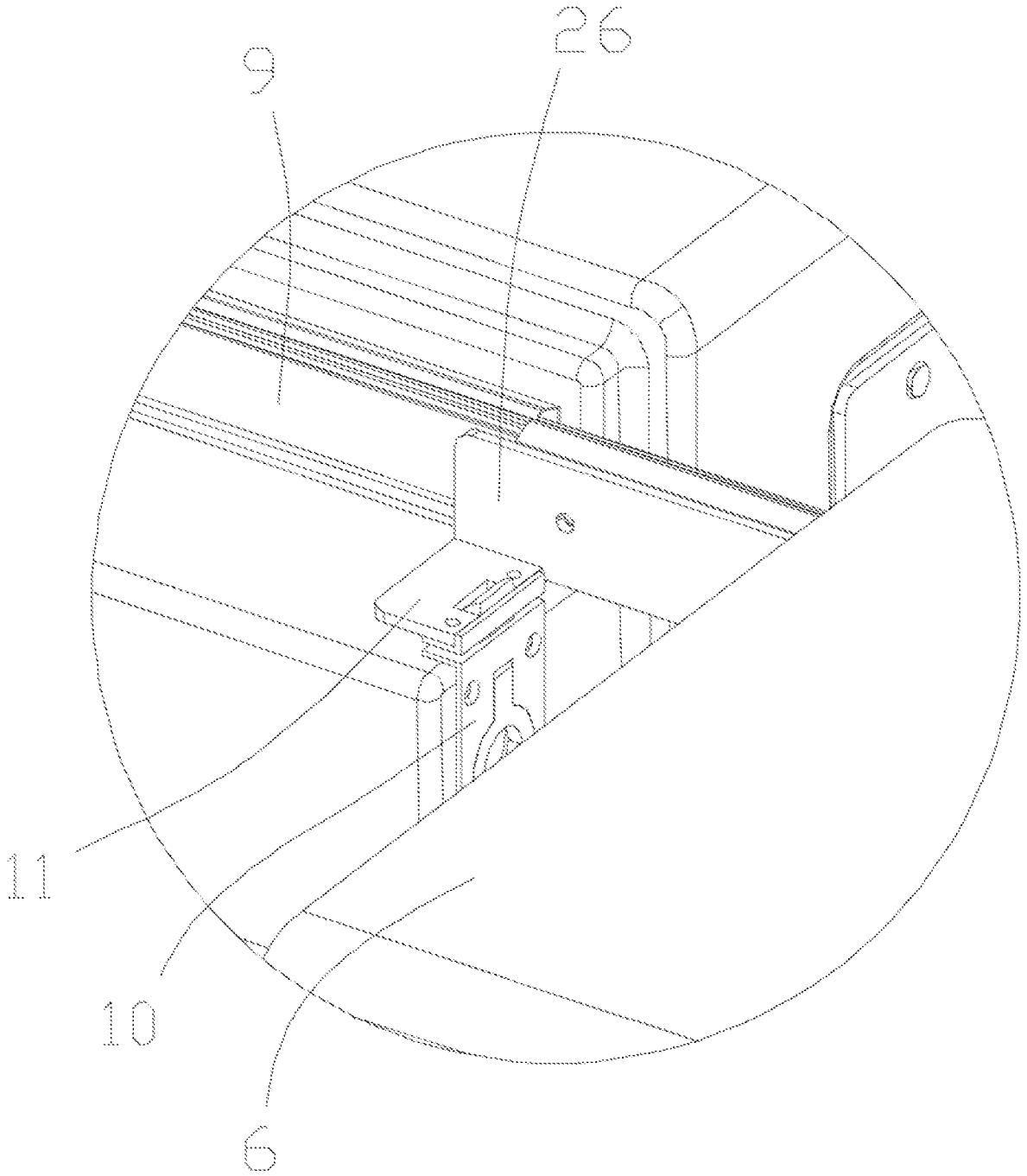
FIG. 6 is a schematic partial enlarged structural diagram of a circle part in FIG. 5.

In addition, to improve stability and reliability of the slide cover 6 during sliding and stability of the slide cover 6 after sliding to a required position, as shown in FIG. 1, FIG. 5 and FIG. 6, the wall of the accommodating recess matches the slide cover 6 through the slide rail 9 such as one slide rail 9 or a plurality of slide rails 9, for example, front and rear slide rails 9 in FIG. 5.

In addition, a limiting pin is formed on one of the slide cover 6 and the left instrument desk body 1, and a limiting sleeve 25 is formed on the other one of the slide cover 6 and the left instrument desk body 1. For example, when the slide cover 6 slides to the open position, the limiting pin separates from the limiting sleeve; and when the slide cover 6 slides to the covering position, the limiting pin extends into the limiting sleeve, to improve stability of the slide cover 6 at the covering position.

In an embodiment, the left instrument desk body 1 is equipped with a locking unit 10, and the slide cover 6 is equipped with an open position locking member 11 and a covering position locking member 12, where when the slide cover 6 slides to the open position, the open position locking member 11 is locked with the locking unit 10. In this case, the support pin 7 extends into the support sleeve 8. In this way, the slide cover 6 at the open position may be prevented from automatically returning, to improve stability. When the slide cover 6 slides to the covering position, the covering position locking member 12 is locked with the locking unit 10, and the limiting pin extends into the limiting sleeve, to improve stability of the slide cover 6 at the covering position. For example, when the slide cover 6 slides outward and reaches a designated stroke, the open position locking member 11 such as a spring lock fixed on a slide cover frame 26 and the locking unit 10 such as a spring lock mounted on the left instrument desk body 1 enter a self-locking state, to prevent the slide cover 6 from automatically returning during operating of the driver. After the operating is completed, the slide cover 6 needs to be closed. In this case, the spring locks may be manually unfastened and the slide cover 6 is slid leftward until the limiting pin on the slide cover 6 extends into the limiting sleeve on the left instrument desk body 1. Meanwhile, after the slide cover 6 comes into contact with a buffer block 23, the covering position locking member 12 is operated with a key and is locked with the locking unit 10, to lock and close the slide cover 6, and the slide cover 6 covers the accommodating recess.

In addition, an accommodation space used for accommodating accessories is formed in the right instrument desk body 2, and because the control device may be disposed on the left instrument desk body 1, the accommodation space in the right instrument desk body 2 may have a large volume. In this way, the accessories such as a rescue ladder, an escape hammer, a cleaning tool of the vehicle, or a module that has a large volume and needs to be frequently overhauled may be accommodated in the accommodation space, to improve space utilization of the vehicle instrument desk device.

In another embodiment, the accommodating recess may be alternatively formed on the right instrument desk body 2. In this case, the accommodation space is formed in the left instrument desk body 1.

In addition, as shown in FIG. 4 and FIG. 5, the control device includes a display screen 13, and the display screen 13 is flippably disposed on the left instrument desk body 1. The display screen 13 is disposed in the accommodating recess and is flippable between a closed state and a use state relative to the accommodating recess, and when in the use state, the display screen is extensible from the accommodating recess and is to be used by an operator; and when in the closed state, the display screen is accommodatable in the accommodating recess. In this way, compared with the existing technology in which a movement control module moves up and down in a cabinet of an instrument desk, this structure of the present disclosure enables the vehicle instrument desk device to be more compact, to reduce an occupied space of the instrument desk and increase a compartment space.

In an embodiment, as shown in FIG. 4 and FIG. 5, the control device includes a primary control panel 14 and a secondary control panel 15, and the primary control panel 14 and the secondary control panel 15 may be fixedly connected to the left instrument desk body 1 by snap-fit or through a screw, where the primary control panel 14 is horizontally disposed in the accommodating recess of the left instrument desk body 1, the secondary control panel 15 is vertically disposed on a mounting table 16 in the accommodating recess. That is, the primary control panel 14 and the secondary control panel 15 are arranged in horizontal and vertical directions, and therefore a space of the accommodating recess may be fully used, to reduce a volume of the vehicle instrument desk device. An end of the display screen 13 is disposed on the mounting table 16 through the damping hinge 5, and the accommodating recess is equipped with a limiting table 17, where in the closed state of the display screen 13, the display screen 13 is located above the primary control panel 14 and keeps an interval away from an operating button on the primary control panel 14 through the limiting table 17, and the slide cover 6 slidingly disposed on the accommodating recess can cover and open the accommodating recess. In this way, the display screen 13 is fixed and connected to the mounting table 16 by selecting the damping hinge 5 of which torque satisfies a weight torque requirement of the display screen. Because of a damping positioning feature of the damping hinge 5, when in the close state, the display screen may be at a horizontal position, and when in the open state, the display screen may stop at any position between, for example, 0° and 150° or 0° and 145°, to satisfy man-machine requirements of different drivers during driving without affecting a front view. Certainly, if needed, the display screen may be further flipped between 0° and 180°. In addition, because of a limiting effect of the limiting table 17 on the display screen, the display screen during closing may be prevented from colliding with a button or the like on the primary control panel 14.

In addition, at least one of the instrument desk body 1 and the right instrument desk body 2 is equipped with a USB charging port 24, as shown in FIG. 5, and the USB charging port 24 is disposed on a side surface of the instrument desk body 1, so that the driver can charge a portable apparatus such as a walkie-talkie in the vehicle.

In addition, an inner space between the vehicle instrument desk device and a vehicle body is equipped with another module that needs to be frequently overhauled. Therefore, a side surface of the vehicle instrument desk device is equipped with an inspection door 18, and only the inspection door 18 needs to be detached during the inspection, to increase convenience of the inspection and improve inspection efficiency. In addition, in an embodiment, a side surface of the right instrument desk body 2 is equipped with components such as the escape door-emergency unlocking switch 20 and the handle 19. Because the right instrument desk body 2 is not equipped with components such as a manipulation panel and a display screen, a space between the right instrument desk body 2 and the vehicle body is large and therefore may be used to dispose a module that has a large volume and needs to be frequently overhauled.

In addition, the present disclosure provides a vehicle, for example, a rail train such as a metro train. A front end of at least one of a head compartment and a tail compartment of the vehicle is equipped with any one of the foregoing vehicle instrument desk devices. It is understandable that the front end of the head compartment refers to an end of the head compartment far away from the tail compartment, and the front end of the tail compartment refers to an end of the tail compartment far away from the head compartment. In this way, as mentioned above, the escape route is added to the vehicle, to significantly improve safety performance of the vehicle.

In the description of the present application, it should be understood that, orientations or position relationships indicated by terms such as "center", "longitudinal", "transverse", "length", "width", "thickness", "up", "down", "front", "back", "left", "right", "vertical", "horizontal", "top", "bottom", "inner", "outer", "clockwise", "counterclockwise", "axial", "radial", and "circumferential" are orientations or position relationship shown based on the accompanying drawings, and are merely used for describing the present application and simplifying the description, rather than indicating or implying that the apparatus or element should have a particular orientation or be constructed and operated in a particular orientation, and therefore, should not be construed as a limitation on the present application.

In addition, terms "first" and "second" are only used to describe the objective and cannot be understood as indicating or implying relative importance or implying a quantity of the indicated technical features. In view of this, a feature defined to be "first" or "second" may explicitly or implicitly include one or more features. In descriptions of the present application, "multiple" means two or more, unless otherwise defined clearly and specifically.

In the present application, unless otherwise clearly specified and limited, terms "mount", "connect", and "fix" should be understood in a generalized manner, for example, may be understood as fixed connection, detachable connection, or integration; or may be understood as mechanical connection or electrical connection; or may be understood as direct connection, or indirect connection by means of a medium, or internal communication of two elements or a mutual relationship between two elements. A person of ordinary skill in the art may understand specific meanings of the terms in the present application according to specific situations.

In the present application, unless explicitly specified or limited otherwise, a first characteristic "on" or "under" a second characteristic may be the first characteristic in direct contact with the second characteristic, or the first characteristic in indirect contact with the second characteristic by using an intermediate medium. In addition, the first feature being located "above" the second feature may be the first feature being located directly above or obliquely above the second feature, or may simply indicate that the first feature is higher in level than the second feature. The first feature being located "below" the second feature may be the first feature being located directly below or obliquely below the second feature, or may simply indicate that the first feature is lower in level than the second feature.

In description of the specification, description of reference terms such as "one embodiment", "some embodiments", "example", "specific example" or "some examples" means including specific features, structures, materials, or features described in the embodiment or example in at least one embodiment or example of the present disclosure. In this specification, exemplary descriptions of the foregoing terms do not necessarily refer to a same embodiment or example. In addition, the described specific features, structures, materials, or features can be combined in a proper manner in any one or more embodiments or examples. In addition, with no conflict, a person skilled in the art can integrate and combine different embodiments or examples and features of the different embodiments and examples described in this specification.

Although the embodiments of the present disclosure are shown and described above, it can be understood that, the foregoing embodiments are exemplary, and cannot be construed as a limitation to the disclosure. Within the scope of the disclosure, a person of ordinary skill in the art may make changes, modifications, replacement, and variations to the foregoing embodiments.

What is claimed is:

1. A vehicle instrument desk device, comprising a left instrument desk body and a right instrument desk body, wherein the left instrument desk body and the right instrument desk body are arranged at an interval to form an escape route between the left instrument desk body and the right instrument desk body, and at least one of the left instrument desk body and the right instrument desk body is equipped with a control device, wherein the left instrument desk body comprises an accommodating recess, and the control device is disposed in the accommodating recess; and a wall of the accommodating recess is slidingly equipped with a slide cover, the slide cover can slide along a reference straight line to open and cover the accommodating recess, and an extending direction of the reference straight line is consistent with a direction from the left instrument desk body to the right instrument desk body.

2. The vehicle instrument desk device according to claim 1, wherein the vehicle instrument desk device comprises an isolation door disposed in the escape route, the escape route is opened when the isolation door is opened, and the escape route is closed when the isolation door is closed.

3. The vehicle instrument desk device according to claim 2, wherein an end of the isolation door is connected to one of the left instrument desk body and the right instrument desk body through a damping hinge, and another end of the isolation door is releasably connected to the other one of the left instrument desk body and the right instrument desk body through a door absorber unit.

4. The vehicle instrument desk device according to claim 1, wherein a support pin is formed on one of the slide cover and the right instrument desk body, and a support sleeve is formed on the other one of the slide cover and the right instrument desk body, wherein when the slide cover opens the accommodating recess, the support pin extends into the support sleeve.

5. The vehicle instrument desk device according to claim 1, wherein when the escape route is equipped with the isolation door and the isolation door closes the escape route, the slide cover can be slidably supported on the isolation door.

6. The vehicle instrument desk device according to claim 1, wherein the wall of the accommodating recess and the slide cover are matched through a slide rail.

7. The vehicle instrument desk device according to claim 6, wherein there are two slide rails, and the two slide rails are respectively arranged in parallel and at an interval on two opposite walls of the accommodating recess.

8. The vehicle instrument desk device according to claim 7, wherein the left instrument desk body is equipped with a locking unit, and the slide cover is equipped with an open position locking member and a covering position locking member, wherein when the slide cover slides to an open position, the open position locking member is locked with the locking unit; and when the slide cover slides to the covering position, the covering position locking member is locked with the locking unit.

9. The vehicle instrument desk device according to claim 1, wherein an accommodation space used for accommodating accessories is formed in the right instrument desk body.

10. The vehicle instrument desk device according to claim 1, wherein the control device comprises a display screen, the display screen is disposed in the accommodating recess and can flip between a closed state and a use state relative to the accommodating recess, and when in the use state, the display screen can extend from the accommodating recess and is to be used by an operator; and when in the closed state, the display screen is accommodatable in the accommodating recess.

11. The vehicle instrument desk device according to claim 10, wherein the control device comprises a primary control panel and a secondary control panel, wherein the primary control panel is horizontally disposed in the accommodating recess of the left instrument desk body, the secondary control panel is vertically disposed on a mounting table in the accommodating recess, an end of the display screen is disposed on the mounting table through the damping hinge, and the accommodating recess is equipped with a limiting table, wherein in the closed state of the display screen, the display screen is located above the primary control panel and keeps an interval away from an operating button on the primary control panel through the limiting table, and the slide cover can slide to cover and open the accommodating recess.

12. A vehicle, wherein a front end of at least one of a head compartment of the vehicle and a tail compartment of the vehicle is equipped with a vehicle instrument desk device, the vehicle instrument desk comprising:

a left instrument desk body and a right instrument desk body, wherein the left instrument desk body and the right instrument desk body are arranged at an interval to form an escape route between the left instrument desk body and the right instrument desk body, and at least one of the left instrument desk body and the right instrument desk body is equipped with a control device, wherein the left instrument desk body comprises an accommodating recess, and the control device is disposed in the accommodating recess; and a wall of the accommodating recess is slidingly equipped with a slide cover, the slide cover can slide along a reference straight line to open and cover the accommodating recess, and an extending direction of the reference straight line is consistent with a direction from the left instrument desk body to the right instrument desk body.

* * * * *